United States Patent [19]

Taubert

[11] 4,033,446

[45] July 5, 1977

[54] THREE-POSITION RIBBON GUIDE FOR PRINTER

[75] Inventor: Werner Taubert, Munich, Germany

[73] Assignee: Siemens Aktiengesellschaft, Berlin & Munich, Germany

[22] Filed: Mar. 8, 1976

[21] Appl. No.: 664,874

[30] Foreign Application Priority Data

Mar. 20, 1975 Germany ..... 2512337

[52] U.S. Cl. ..... 197/157; 197/159; 178/23 R; 335/189

[51] Int. Cl.[2] ..... B41J 35/10; B41J 35/20

[58] Field of Search ..... 197/72, 151, 154–159; 74/25, 99, 128; 310/23, 24; 335/189, 190, 191, 267; 346/105, 106; 101/336

[56] References Cited

UNITED STATES PATENTS

| | | | |
|---|---|---|---|
| 1,493,468 | 5/1924 | Camp | 74/99 X |
| 2,715,840 | 8/1955 | Binks et al. | 74/128 |
| 3,743,073 | 7/1973 | Perez | 197/55 |
| 3,891,078 | 6/1975 | Jung | 197/157 X |
| 3,952,853 | 4/1976 | Feldman | 197/55 |

FOREIGN PATENTS OR APPLICATIONS

| | | | |
|---|---|---|---|
| 597,675 | 5/1934 | Germany | 197/157 |

*Primary Examiner*—Edgar S. Burr
*Assistant Examiner*—Paul T. Sewell
*Attorney, Agent, or Firm*—Hill, Gross, Simpson, Van Santen, Steadman, Chiara & Simpson

[57] ABSTRACT

A three-position ribbon guide comprises a ribbon guide bar which is pivoted at one end and carries a ribbon guide at an opposite end. Arranged transversely to the guide bar, one above and one below, are two pivotable armature levers each coupled to the guide bar by a pin which rides in a slot in the guide bar. Each slot has a generally vertical and a horizontal portion. An armature fixed in each lever near a pivot axis thereof is subjected selectively to a magnetic attraction when a current flows through an adjacent electromagnet. Energization of one or the other of the electromagnets will pivot the lever and cause its coupling pin to slide along the horizontal portion of the slot in the guide bar. Such movement raises the ribbon guide bar about its pivot, the coupling pin of the other lever remaining steady but sliding through the vertical portion of the guide slot thereof as the guide bar moves. A return spring maintains each armature lever in an inactive position when the respective electromagnet has no current flow therethrough.

6 Claims, 2 Drawing Figures

THREE-POSITION RIBBON GUIDE FOR PRINTER

BACKGROUND OF THE INVENTION

1. Field of the Invention

The present invention relates to printers having an arrangement for switching the ribbon guide among three positions, having two electromagnets each with an armature mounted on a pivoted armature lever which is in turn connected to the ribbon guide bar.

2. Prior Art

Printers such as teleprinters require switching of a one- or two-colored ribbon from a black or upper position into a red or lower position, usually by raising and lowering a ribbon guide carrying the ribbon. Also, to allow viewing of the printed matter, a further, so-called visibility position of the ribbon is necessary. Thus, the ribbon guide in a printer must be able to be switched into any of three positions.

It is known to provide a ribbon control system having two electromagnets. Magnetic armatures are each arranged on an armature lever which is in turn connected to the ribbon guide bar so that a movement of the armature levers is transmitted to the ribbon guide bar to move the bar upwardly or downwardly. The third position of the ribbon guide is obtained upon the absence of current in both electromagnets, when the ribbon guide assumes a central position between the upper and the lower position. A problem presented by these devices is in safely and assuredly maintaining the ribbon guide in this third, non-printing position.

SUMMARY OF THE INVENTION

A ribbon guide bar is provided for a printer assembly comprising a pair of armature levers carried pivotally on pins spaced transversely to an axis of the guide bar in its horizontal or center position. The armature levers are actuated, for movement in a plane formed by the guide bar, by an electromagnet in one direction and by a return spring in an opposite direction. An end of each lever carries a coupling pin. The ribbon guide bar is pivoted at one end about an axis parallel to the armature lever pins and carries a ribbon guide at its opposite end. The ribbon guide bar further comprises a pair of guide slots formed in the bar midway between its ends and spaced apart transversely of the axis of the bar. Each guide slot slidably but closely engages one of the coupling pins of the levers. Each guide slot has a first, generally vertical portion and a second, horizontal portion extending parallel to the axis of the bar. One end of each portion of each slot overlies the other to form a continuous, L-shaped slot through which the connecting pin may continuously move. The vertical portion may have a radius equal to the distance from its median plane to the guide bar pivot axis. A return spring acting in opposition to the electromagnetic actuators preferably has a steep characteristic curve whereby resilient force increases sharply with increased displacement from the non-actuated position of the actuating lever.

DESCRIPTION OF THE PREFERRED EMBODIMENTS

Figure 1:
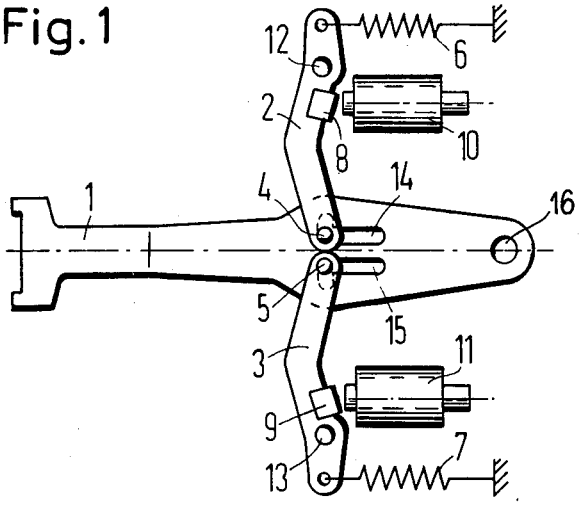
FIG. 1 is a side view of a ribbon guide assembly in its central position.

In FIG. 1 is illustrated a ribbon guide bar 1 which is pivoted upon a transverse pin 16 for upward and downward movement under control of armature levers 2, 3. The levers 2, 3 each carry a coupling pin 4 or 5 at their connection to the ribbon guide bar 1. At their other end the armature levers are each engaged by a return spring 6 or 7 which is linked to a housing of the printer (shown schematically). On each armature lever 2, 3 is arranged an electromagnetic armature 8 or 9, each of which is spaced adjacent a fixed electromagnet 10 or 11 having a horizontal axis. Each armature lever 2, 3 is pivoted about a lever pivot pin 12 or 13.

Each coupling pin 4, 5 of the armature levers 2 and 3 is held closely but slidably in a guide slot 14 or 15 in the ribbon guide bar 1. The guide slots 14 and 15 each have two portions arranged at right angles to one another, the end of one portion opening to an end of the other. A first, generally vertical portion of each guide slot 14, 15 may be straight due to its short length, but preferably, as shown in the drawing, has a radius of curvature equal to a distance from its median or center line to the guide bar pivot axis in the pin 16. A second, horizontal portion of each guide slot 14, 15 extends parallel to the axis of the guide bar 1. The coupling pin 4 or 5 of each armature lever 2, 3 thus may move through an arc to the right about the respective pivot axis 12 or 13, while the coupling pin 5 or 4, respectively, of the other, non-actuated armature lever 3 or 2 remains stationary as the generally vertical portion of the corresponding slot 15 or 14 moves past it.

In FIG. 1, in which neither of the two electromagnets is actuated, the guide bar 1 is locked in a central position, wherein the two return springs 6, 7 cause the coupling pins 4, 5 to lock the ribbon guide bar 1 firmly by the inner sides of the guide slots 14 and 15.

Figure 2:
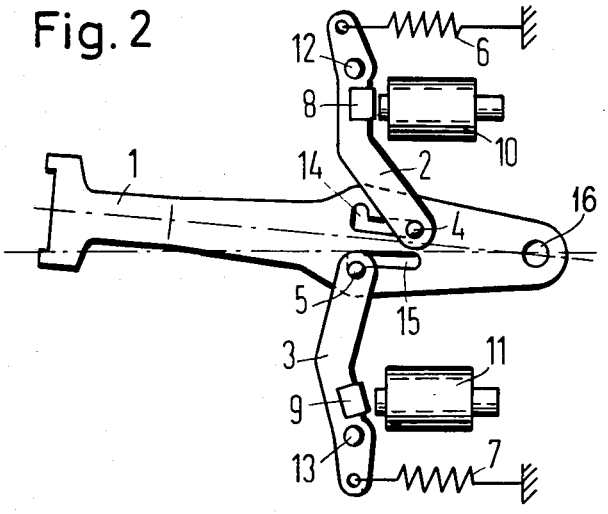
FIG. 2 is a side view of a ribbon guide assembly in which the upper electromagnet has been actuated to move the guide bar to an upper position.

To switch the ribbon guide bar 1 from the central position shown in FIG. 1, one of the two electromagnets 10 and 11 is actuated, as by passing a current therethrough. In FIG. 2, the upper electromagnet 10 has been actuated to move the lever 2 as shown. The coupling pin 4 of the upper armature lever 2 first executes a free movement over a short stroke past the area of the vertical portion of the guide slot 14. Then the coupling pin 4 slides through the horizontal portion of the guide slot 14 but rises in swinging through an arc about the lever arm pivot pin 12. Such movement causes the ribbon guide 1 to move upwardly. Simultaneously, the vertical part of the guide slot 15 slides upwardly past the stationary coupling pin 5 of the non-actuated lower armature lever 3. Thus, no opposition to the movement of the ribbon guide bar 1 is imposed. In the final position, as illustrated in FIG. 2, the ribbon guide is firmly locked by the coupling pins 4, 5 engaging respective ends of the guide slots 14, 15. When the actuated electromagnet 10 is thereafter switched off, the return spring 6 causes an immediate movement of the lever 2 and thence the guide bar 1 into the positions of FIG. 1.

The described processes take place in similar fashion when the lower electromagnet 11 is actuated.

The return springs 6 and 7 are preferably selected so that at the beginning of a movement of the lever 2 or 3, when a large air gap exists between the armatures 8, 9 and the electromagnets 10, 11, respectively, only a relatively small amount of power is required, but when the armature is close to the electromagnet the returning force of the spring is considerable. Suitable springs have steep characteristic curves in a plot of spring force on a vertical axis as against displacement upon a horizontal axis. Widening of the vertical portions of the guide slots 14 and 15 permits an idle stroke of the coupling pin 4 or 5 while the air gap between the armature 8, 9 and the electromagnet 10, 11 is large, further reducing initial power requirements.

Although various minor modifications in the layout and structuring of the embodiments shown will be suggested by those versed in the art, it should be understood that I wish to embody within the scope of the patent warranted hereon all such modifications as reasonably and properly come within the scope of my contribution to the art.

I claim as my invention:

1. A ribbon guide bar for a printer assembly comprising a pair of armature levers carried pivotally on pins spaced transversely to an axis of said guide bar in a horizontal, center position for movement in a plane formed by said guide bar, each said lever being actuated by an electromagnet in one direction and by a spring in an opposite direction and carrying at an end thereof a coupling pin, the ribbon guide bar being pivoted at one end about an axis parallel to said armature lever pins and carrying a ribbon guide at an opposite end and comprising:

a pair of guide slots formed in said bar between said ends, spaced apart transversely of said guide bar axis, each said slot slidably but snugly receiving one of said coupling pins of said levers and comprising a first, generally vertical portion having an end spaced adjacent said guide bar axis, and second horizontal portion extending parallel to said guide bar axis and having an end coinciding with said end of said first slot portion, whereby each coupling pin may travel freely between said first and second guide slot portions, whereby said guide bar may be locked in any of three positions by said coupling pins in said guide slots depending upon actuation of said electromagnets.

2. A ribbon guide bar as defined in claim 1, wherein the first, generally vertical portion of each of said guide slots has a radius of curvature equal to a distance from its median to said guide bar pivot axis.

3. A ribbon guide assembly for a printer comprising:

a ribbon guide bar mounted upon a horizontal pivot axis in one end thereof in said printer, said guide bar having a ribbon guide at an opposite end and a pair of guide slots arranged symmetrically of said guide bar about an axis of said bar, each said guide slot having a width and a first, generally vertical portion transverse to said bar axis, and a second, straight portion having a first end coinciding with an end of said first, vertical portion nearer said bar axis, the second portion extending parallel to said bar axis and spaced therefrom;

a pair of armature levers arranged transversely to said ribbon guide bar axis in a centered position thereof, said levers each comprising a lever pivot axis spaced a distance from said guide bar axis and parallel to said guide bar pivot axis, a coupling pin in an end of said lever, said pin riding in a nearer one of said guide slots of said ribbon guide bar and having a diameter slightly less than the width of said guide slot, and a magnetic armature fixed in said lever and spaced adjacent said lever pivot axis;

a pair of electromagnets each fixed in said printer upon a magnet axis parallel to said guide bar axis in said centered position of said guide bar and in a position to magnetically attract a corresponding one of said armatures in said levers; and a pair of return springs each engaging one of said levers to act thereon in opposition to a corresponding one of said electromagnets, whereby actuation of one of said magnets moves the guide bar to a first position, actuation of the other of said magnets moves the guide bar to a second position, and actuation of neither magnet leaves the guide bar locked in a third, centered position.

4. A ribbon guide assembly as defined in claim 3, wherein each of said return springs engages its corresponding lever opposite said lever pivot axis from said coupling pin.

5. A ribbon guide assembly as defined in claim 3, wherein each said armature is located between said lever pivot axis and said coupling pin.

6. A ribbon guide assembly as defined in claim 3, wherein each said return spring has a steep characteristic curve of spring force versus displacement.

* * * * *